United States Patent [19]

Bradley et al.

[11] Patent Number: 4,658,178

[45] Date of Patent: Apr. 14, 1987

[54] PLASTICS SKIRT FOR RIGIDLY INTERCONNECTING METALLIC BASE AND GLASS ENVELOPE OF A LAMP

[75] Inventors: Irving Bradley, Russell Township, Geauga County; Paul A. Moore, Chardon, both of Ohio

[73] Assignee: General Electric Company, Schenectady, N.Y.

[21] Appl. No.: 681,742

[22] Filed: Dec. 14, 1984

[51] Int. Cl.[4] ..... H01J 5/36; H01J 5/60

[52] U.S. Cl. ..... 313/113; 313/318; 362/296

[58] Field of Search ..... 313/113, 318, 579, 580; 362/346, 297, 310, 296, 341, 375; 339/144–146

[56] References Cited

U.S. PATENT DOCUMENTS

| | | | |
|---|---|---|---|
| 3,746,906 | 7/1973 | Cardwell, Jr. | 313/318 |
| 4,370,587 | 1/1983 | Notelteirs | 313/113 |
| 4,427,255 | 1/1984 | Cox | 362/296 X |

FOREIGN PATENT DOCUMENTS

| | | | |
|---|---|---|---|
| 339927 | 12/1930 | United Kingdom | 313/318 |

OTHER PUBLICATIONS

"Lamp Circuitry Collar": by A. Smetano, *May 1983 Plastic World Magazine.*

*Primary Examiner*—Palmer C. DeMeo
*Assistant Examiner*—Sandra L. O'Shea
*Attorney, Agent, or Firm*—John P. McMahon; Philip L. Schlamp; Fred Jacob

[57] ABSTRACT

A lamp is disclosed comprising a light source, an outer glass envelope having at least one dimple, a metallic base having at least one dimple, and a plastics skirt having means for complementary engaging and fastening to each of the dimples of the glass envelope and of the metallic base. The complementary engagement of the plastics skirt to the glass envelope is accomplished by snap-lock ramp-like extensions that fit into and engage an inner portion of the dimples of the glass envelope.

8 Claims, 6 Drawing Figures

Fig. 2
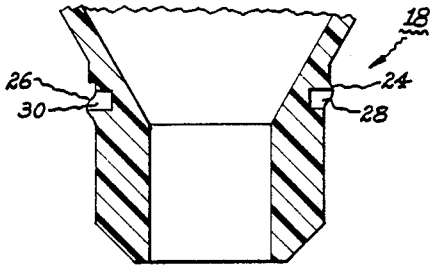
Fig. 3
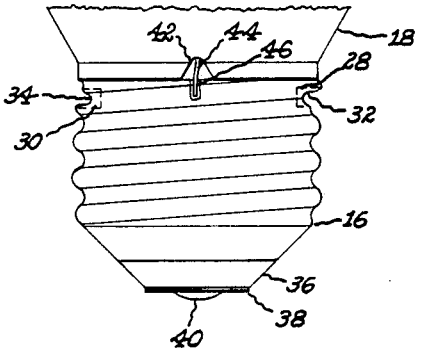
Fig. 4
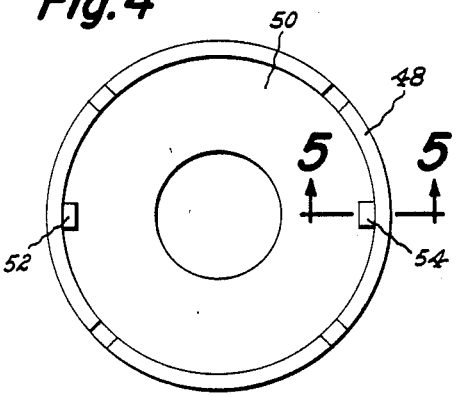
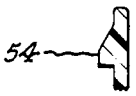
Fig. 5
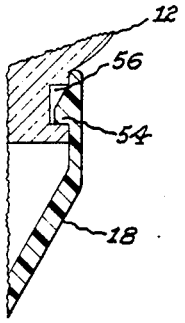
Fig. 6

PLASTICS SKIRT FOR RIGIDLY INTERCONNECTING METALLIC BASE AND GLASS ENVELOPE OF A LAMP

BACKGROUND OF THE INVENTION

This invention relates to electric lamps having a plastics skirt and, more particularly, to an organic polymer or plastics skirt formed of material capable of withstanding high temperatures and having means for engaging and fixing the plastics skirt to a glass envelope and a metallic base both of the electric lamp.

Plastics skirts are known as a replacement of metallic collars in the lamp art. Replacement plastics skirts provide the means for reducing or even eliminating an arc problem related to metal-to-glass insulated screw bases of lamps. Many lamps, particularly high voltage lamps, operate at high voltage potentials and arcing conditions between the metal base and the metallic and glass insulated collar which are possible failure modes of the lamp. The plastics skirt provides a means to substantially reduce these possible arc problems in addition to reducing any shock hazard of the collar of the lamp. One such plastics skirt is described in a technical article entitled "Lamp Circuitry Collar" by A. Smetana of GE Lighting Business Group of Ohio, published in the *May* 1983 *plastics world magazine.*

The plastics skirt of Smetana rigidly affixes to both the glass bulb and to the metallic base of the lamp. The rigid affixation of the plastics skirt of Smetana prevents the skirt from rotating on the bulb during unscrewing. The non-rotation is provided by "staking" which is accomplished by injecting molten solder through two small holes in opposite sides of the plastic skirt and into small depressions in the glass envelope so as to form solder locks. This injection molten solder process forming the solder locks while performing its desired non-rotation of the plastics skirt has disadvantages. The formation of the solder locks is a relatively slow process requiring time for the first solder to set or freeze, then a 180 degree rotation of the skirt and glass to form the second solder lock and then allowing for its related setting time. In addition, the related operation temperature for the solder locks is that of the molten high temperature of solder having a melting temperature of about 495 degrees Fahrenheit.

It is desired that means other than molten solder locks be provided which connects the plastics skirt to both the brass base and the glass bulb and does not have the limitations of the prior art. It is further desired that this means be an integral part of the plastics skirt itself.

Accordingly, an object of the present invention is to provide means formed as an integral part of the plastics skirt so as to rigidly affix the plastics skirt to both the glass envelope and the metal base all of the lamp.

SUMMARY OF THE INVENTION

This invention is directed to a lamp having a plastics skirt that rigidly engages and affixes to a glass envelope and to a metallic base both of the lamp.

The lamp comprises an outer glass envelope having at least one dimple at its lower portion and a light source disposed within the outer envelope. The lamp further comprises a metallic base having at least one dimple at its open upper portion. The lamp further has a plastics skirt having means for complementary engaging and affixing to the dimples of each of the glass envelope and the metallic base. The complementary engaging and affixing of the plastics skirt to the glass envelope is accomplished by ramp-like semi-flexible extensions integrally formed in the plastics skirt which fit into and engage an inner portion of the dimple of the glass envelope.

BRIEF DESCRIPTION OF THE DRAWING

FIG. 2 is a segmented view illustrating the shank portion of the plastics skirt of FIG. 1.

FIG. 3 partially illustrates the plastics skirt mating to the metallic base.

FIG. 4 is a top view of the plastics skirt of the present invention.

FIG. 5 is a sectional view along lines 5—5 of FIG. 4 showing in more detail a ramp-like extension of FIG. 4.

FIG. 6 is a segmented view showing the mating of the plastics skirt to the glass envelope.

DETAILED DESCRIPTION OF THE PREFERRED EMBODIMENT

Figure 1:
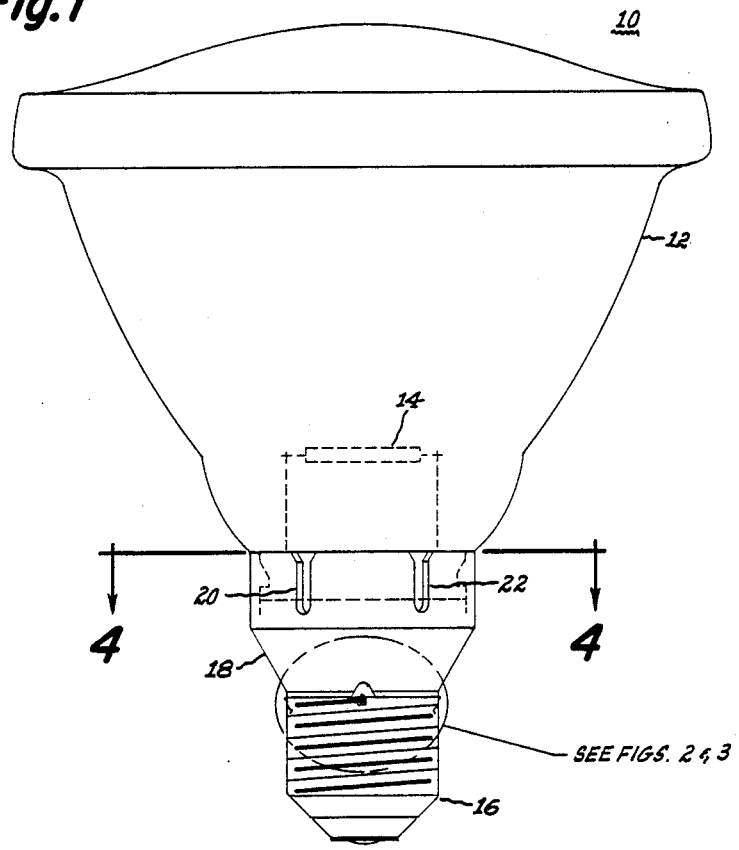
FIG. 1 illustrates a PAR lamp in accordance with one embodiment of the new invention.

FIG. 1 illustrates a parabolic aluminized reflector (PAR) in accordance with one embodiment of the present invention. The PAR lamp 10 has an outer envelope 12 having at least one dimple indentation at its lower rim portion to be described hereinafter with regard to FIG. 6. The inner and outer surfaces are appropriately contoured and coated in manner well known in the PAR lamp art.

Lamp 10 has a light source 14 shown in phantom disposed within the outer envelope 12. The light source has a central portion located at the focal point of the lamp 10 and may be an incandescent filament or a halogen light source.

The lamp 10 further has a metallic base 16 preferably of a brass material and has at least one dimple indentation at its upper portion to be described hereinafter with regard to FIG. 3.

The metallic base 16 and also the outer envelope 12 are both connected to a plastics skirt 18 having means for complementary engaging and affixing to the dimples of the glass envelope and the metallic base. The plastics skirt 18, which is of primary importance to the present invention, provides for the complementary engaging and fastening of the plastics skirt 18 to glass envelope by ramp-like extensions integrally formed into the plastics skirt which fit into and engage an inner portion of the dimples of the glass envelope. The ramp-like extensions provide snap-lock engagement of the glass envelope to the plastics skirt. The plastics skirt 18 preferably has four slots which embrace the outer envelope 12 and two of which are shown as 20 and 22 in FIG. 1. The slots provide assistance in flexing to the circular cross-section of the plastics skirt 18 during the assembly of the plastics skirt 18 to the glass envelope 12. The plastics skirt 18 is further shown in FIG. 2.

FIG. 2 shows the lower or shank portion of the plastics skirt 18 as having two partial screw thread members 24 and 26 molded into the shank portion of the plastics skirt 18. The partial screw threads 24 and 26 are selected to have dimensions to match the internal rolled thread of the screw type metallic member 16 and provide tight engagement between the rim of the screw member 16 and the shoulder of the shank portion of the skirt 18. The shank portion of skirt 18 has a diameter selected to have dimensions which matches the minor internal thread diameter of the metallic base 16 so as to improve the lateral support of the base 16 and skirt 18 when so mated.

The shank portion of skirt 18 has a conical shape which fits closely into the interior cone dome shape of the metal base 16. The conical shape of the skirt shank serves an important feature of the present invention, that being supporting the cone dome of the base shell 16 so as to substantially prevent any crushing action of the shell 16 when the shell 16 is screwed into a complementary electrical socket. The crushing action may otherwise be present given the large moment arm created by the relative large bulb diameter of the PAR lamp. This conical shape also allows for a reduction in the gauge of the metal of the screw 16 yielding benefits of reduced cost.

The shank portion of the plastics skirt 18 has at two locations 180 degrees apart from each other, two essentially symmetrical indents 28 and 30 which are molded into the plastics skirt 18. These indents 28 and 30 receive and are matched to dimples 32 and 34 shown in FIG. 3 as located in the upper end of the base 16. FIG. 3 shows the base as also having a glass insulator 36, a brass eyelet 38, and button-like member 40. The plastics skirt 18 may also have a cutout 42 to allow the exit of a lead wire 44 of lamp 10 to be connected to the base 16 by appropriate means such as a weld 46. The dimples 32 and 34 of FIG. 3 are formed by staking, pinning, or other similar processes into the base 16 after assembly of the base 16 to the skirt 18. The dimples 32 and 34 engage the indents 28 and 30 of the skirt 18 which are shown in FIG. 3 in phantom.

The combination of the partial threads 24 and 26 of FIG. 2 of skirt 18 mating with base 16, the complementary shapes of the skirt 18 and base 16, and the indents 28 and 30 along with the dimples 32 and 34 provide for essentially non-rotation between the skirt 18 and base 16 when the lamp 10 is screwed into and out of a mating electrical socket.

The rigid mating of the plastics skirt 18 to the glass envelope 12 may be described by first referring to FIG. 4. FIG. 4 shows a top view of the plastics skirt 18 as having an an outer rim 48 and contoured side walls 50 having a shape as that shown in FIG. 1. The plastic skirt 18 has integrally formed therein ramp-like extensions 52 and 54 that fit into and engage the inner portions of dimples 56 and 58 (not shown) of the glass envelope. The preferred location of the ramp-like extensions 52 and 54 below the top surface of the skirt 18 along lines 5—5 of FIG. 4, is shown in a sectional view of the ramp-like extension 54 in FIG. 5. The mating of the ramp-like extension 54 is shown in FIG. 6.

FIG. 6 is a cross-sectional view showing the ramp-like extension 54 fitting into and engaging the inner portion of the dimple 56 of the glass envelope 12. The dimple 56 is formed into the lower rim portion of the glass envelope during its molding process.

The ramp-like extensions 52 and 54 integrally formed into the skirt 18 may all be formed of a plastics material polyetherimide having a tradename Ultem and which is available from the Plastics Department of the General Electric Company of Pittsfield, Mass. The plastics material may also be a polyethersulfone material available as Victrex from ICI Americas.

The skirt 18 formed from either of the polyetherimide or polyethersulfone material is capable of withstanding high temperatures in a range of about 329 to 426 degrees Fahrenheit. Further, for application temperatures of the skirt 18 up to 525 degrees Fahrenheit, plastics such as poly (amide-imide) may be used and are available from Amoco Chemicals Co. Still further, plastics such as polyimide available from the companies of DuPont and Upjohn may be used for application of the skirt 18 for temperatures in the range of about 530 to about 680 degrees Fahrenheit. The plastics skirt 18 provides sufficient flexing so that the assembly of the skirt 18 to envelope 12 does not permanently deform either the skirt 18 or its ramp-like extensions 52 and 54. The amount of flexing of the skirt 18 without permanent deformation, given a desired height of the ramped extensions 52 and 54, depends on the length, width and section modulus of the slotted portion integral with the ramp extensions 52 and 54 and the flexural strength of the material of the skirt 18. Such calculations are well-known in the art.

In accordance with the practice of the present invention, the plastics skirt 18 was mated and connected to both the metallic base 16 and to the glass outer envelope 12. The assembled lamp was then subjected to a torque-like force equivalent to that encountered during the screwing of the lamp 10 into an appropriate electrical socket without causing any substantial rotation between any of the skirt 18 glass envelope 12 or metallic screw 16 member.

It should now be appreciated that the practice of the present invention provides for a plastic skirt having snap-lock means for a lamp that rigidly engages and affixes to an outer glass envelope and to a metallic base 16.

It should be further appreciated that although the present invention has been described as related to a PAR lamp, the principles of this invention are equally applicable to other type lamps. For example, the plastics skirt 18 may provide a collar type housing for lodging electrical components for high pressure metal vapor lamps. Similarly, the skirt 18 may be provided for an improved incandescent type lamp as a housing for lodging electrical components. Still further, although the present invention has described the glass envelope and metal screw base as each having two dimples engaged and affixed to the plastics skirt, the practice of the invention contemplates the matching of the plastics skirt to one or more than two dimples of each of the glass envelope and metal screw base.

What we claim as new and desire to secure by letters patent of the United States is:

1. A lamp comprising:

(a) an outer envelope having at least one dimple at its lower rim position;

(b) a light source disposed within said outer envelope;

(c) a screw-type metallic base having at least one dimple at its upper portion; and (d) a plastics skirt having means of complementary engaging and fastening to said dimples of the glass envelope and metallic base, said complementary engaging and fastening of the plastics skirt to the glass envelope being accomplished by ramp-like extensions integrally formed into the plastics skirt and which fit into and engage an inner portion of the dimple of the glass envelope.

2. A lamp according to claim 1 wherein said lamp is a Parabolic Aluminized Reflector (PAR) lamp.

3. A lamp according to claim 1 wherein each of said outer envelope and said metallic base have two dimples.

4. A lamp according to claim 1 wherein said plastics skirt is formed of plastics material selected from the group consisting of polyetherimide, polyethersulfone, poly (amide-imide) and polyimide.

5. A lamp according to claim 1 wherein said plastics skirt further comprises a plurality of slots which embrace the glass envelope.

6. A lamp according to claim 1 wherein said means of complementary engaging and fastening said metallic base to said plastics skirt comprises indents in the plastics skirt which engage an inner portion of the dimple of the metallic base.

7. A lamp according to claim 1 wherein said plastics skirt has an opening to allow the exiting of a lamp lead of said lamp for attachment to the outer portion of the screw-type metallic base.

8. A lamp according to claim 1 wherein said plastics skirt has a shank portion having a conical shape and fits closely into the interior of the screw-type metallic base having a cone dome shape.

* * * * *